US005813549A

United States Patent [19]

Sheehan et al.

[11] Patent Number: 5,813,549

[45] Date of Patent: Sep. 29, 1998

[54] STORAGE RACK

[76] Inventors: Michael P. Sheehan, 2675 S. Columbine St., Denver, Colo. 80210; Martin D. Gaeth, 8301 E. Lehigh Dr., Denver, Colo. 80237

[21] Appl. No.: 746,079

[22] Filed: Nov. 6, 1996

[51] Int. Cl.[6] ..... A47F 5/08

[52] U.S. Cl. ..... 211/87.01; D6/569; 248/558; 211/59.1

[58] Field of Search ..... 211/32, 34, 35, 211/87, 59.1, 70.5, 70.6; D6/569, 570, 552; 248/558, 220.31

[56] References Cited

U.S. PATENT DOCUMENTS

| | | | |
|---|---|---|---|
| D. 96,363 | 7/1935 | Arnold | 211/59.1 X |
| D. 191,709 | 11/1961 | Shock | D6/552 |
| D. 211,635 | 7/1968 | Holm | D6/552 |
| D. 291,031 | 7/1987 | Luongo | D6/569 X |
| D. 304,793 | 11/1989 | Burke | D6/569 |
| D. 306,385 | 3/1990 | Alexander et al. | D6/552 |
| D. 320,325 | 10/1991 | Barfield | D6/552 |
| 410,175 | 9/1889 | McAlister | 211/59.1 X |
| 444,328 | 1/1891 | Boss | 211/59.1 |
| 1,188,452 | 6/1916 | Johnson . | |
| 1,561,201 | 11/1925 | Wocel et al. | 211/59.1 |
| 3,168,200 | 2/1965 | Larson | 211/177 |
| 3,255,987 | 6/1966 | Gatch | 248/223 |
| 3,912,212 | 10/1975 | Betts, Sr. | 248/73 |
| 3,941,343 | 3/1976 | Kennedy | 248/223 |
| 4,485,929 | 12/1984 | Betts, Sr. | 211/59.1 X |
| 4,606,466 | 8/1986 | Frederickson | 211/59.1 |
| 4,932,538 | 6/1990 | Gambello | 211/87 |
| 5,009,381 | 4/1991 | Hermanson | 248/221.1 |
| 5,083,668 | 1/1992 | Bushey | 248/220.31 |
| 5,094,352 | 3/1992 | Green, Sr. et al. | 211/186 |
| 5,097,966 | 3/1992 | Miller | 211/87 |
| 5,163,567 | 11/1992 | Betts, Sr. | 211/75 |
| 5,499,724 | 3/1996 | Nickman | 211/70.6 |
| 5,503,276 | 4/1996 | Fierce | 211/64 |

FOREIGN PATENT DOCUMENTS 2224885 11/1973 Germany .

OTHER PUBLICATIONS

Popular Mechanics, article, item 2, published Feb. 1978.

*Primary Examiner*—Blair Johnson
*Attorney, Agent, or Firm*—John E. Reilly

[57] ABSTRACT

A storage rack which may be attached to a supporting surface, such as a wall, so that one or more objects may be placed upon the rack to be stored upon the wall. The storage rack has a compact base with two or more pairs of peg holes, and two or more pegs that may be inserted into any selected pair of the holes. Objects to be stored are placed on and between the inserted pegs. The pairs of holes are separated by different distances. The distance between inserted pegs can be adjusted to accommodate the object to be stored by choosing one or the other of the pairs of holes and then attaching the base to the wall with the chosen pair of holes in position to receive the pegs for use.

14 Claims, 3 Drawing Sheets

STORAGE RACK

BACKGROUND AND FIELD OF INVENTION

The invention relates to storage racks, and more particularly relates to a storage rack which may be mounted in different orientations in order to store or hang objects of differing sizes or configurations therefrom.

A variety of storage rack devices are known in the art for providing some flexibility in storing objects upon a supporting surface. U.S. Pat. No. 3,941,343 to Kennedy for example, discloses a bracket support assembly having a semi-flexible web portion to be mounted parallel to the supporting surface and having holes therein and a holding member thereon, with a single hook bracket selectively disposable in the various holes and engageable with the holding member. Kennedy's bracket assembly uses only one hook bracket member, thus limiting the variety of sizes and types of objects it can store.

U.S. Pat. No. 4,606,466 to Fredrickson shows a display device having multiple pegs specially engageable into evenly spaced keyholes running along a horizontally mounted support bar. Because the device is intended for hanging prepacked goods by slipping one peg through single holes in multiple packages, the support bar is lengthy and the distance between adjacent pegs is generally uniform.

U.S. Pat. No. 5,097,966 to Miller discloses a storage rack having a very elongated base with a row of aligned equidistantly spaced holes for receiving support rods. The device permits some storage flexibility by fixing the elongated base in a horizontal position and inserting the support rods in various equidistantly horizontally spaced holes.

U.S. Pat. No. 5,499,724 to Hickman shows a tool rack device similar in many respects to the Miller device. The utility of the device is limited by the incremental spacing of support pins disposed along a lengthy horizontal frame member.

Thus, a need remains for a storage rack device which is simple and very compact, but which is versatile to permit the storage thereon of objects of differing size or shape. Against the foregoing background, the present invention was developed.

SUMMARY OF THE INVENTION

An object of the invention is to provide a storage rack that is simple to make and use, but which may be manipulated to permit storage or suspension of objects of different sizes or shapes.

Another object of the invention is to provide a storage rack which is compact in size, may be used upon a narrow or small supporting surface, and, it is easy to transport, store, and install.

In accordance with the present invention, there is provided a storage rack including a base member which is attachable to an upright support surface, and which has a front surface and a back surface, a first pair of peg bores at least partially penetrating into the base member, this first pair of peg bores defining a first pair of apertures in the front surface of the base member, the first pair of apertures being separated by a first distance, a second pair of peg bores at least partially penetrating into the base member, this second pair of peg bores defining a second pair of apertures in the front surface of the base member, this second pair of apertures being separated by a second distance, and two elongate pegs, each insertable into the support peg bores, and wherein the first distance between the first pair of apertures is substantially greater than the second distance between the second pair of apertures.

In further accordance with the invention, there is provided a storage rack for storing objects of disparate sizes upon an upright supporting surface, the storage rack including a base member attachable upon the supporting surface, the base member including a front surface and a back surface, a first pair of peg apertures in the front surface, which apertures are separated by a first distance, a first pair of peg bores, each of which has an axis and at least partially penetrates the base member from a corresponding one of the first pair of peg apertures, a second pair of peg apertures in the front surface, which apertures are separated by a second distance, and a second pair of peg bores, each of which has an axis and at least partially penetrates the base member from a corresponding one of the second pair of peg apertures, and the storage rack further includes means for attaching the base member to the supporting surface, and at least two elongate pegs frictionally engageable into a selected pair of the pairs of peg bores, wherein the first distance between the first pair of apertures is substantially greater than the second distance between the second pair of apertures, and also wherein the apertures of the selected pair of peg bores define a substantially horizontal imaginary line when the base member is attached upon the upright supporting surface.

Accordingly, a compact storage rack is provided which may be attached to the supporting surface in at least two different orientations with respect to the surface in order to accommodate the storage of items of different sizes.

The above and other objects, advantages and features of the present invention will become more readily appreciated and understood from a consideration of the following detailed description of preferred and modified forms of the present invention when taken together with the accompanying drawings in which:

DETAILED DESCRIPTION OF PREFERRED EMBODIMENT

Figure 1:
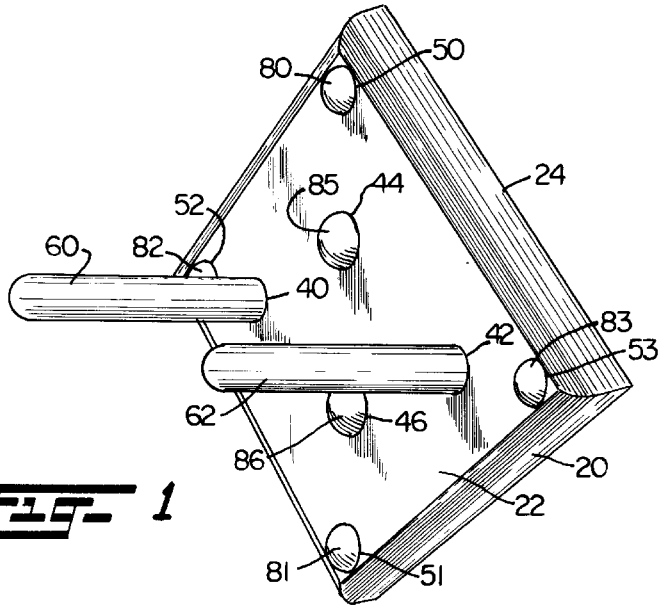
FIG. 1 is a perspective view of a preferred embodiment of the invention, showing a pair of pegs in one pair of bores in a base member and additional pairs of pegs.

The preferred embodiment of the apparatus of the invention comprises a storage rack for use upon an upright supporting surface such as a wall, pillar, or wide post, door or the like. It is contemplated that the supporting surface be substantially vertical from the floor or ground, but this is not absolutely necessary to the practice of the invention. The apparatus of the invention may be used singly or in series, and if used in series may be positioned in vertical or horizontal rows, or in abstract or geometric arrays, upon the supporting surface. Accordingly, a plurality of the racks of this invention may be used to store separate objects at various heights above the floor, on either side of a window or the like, and otherwise may take into account the particular configuration or condition of the supporting surface.

The invention finds utility for the storage of a variety of objects, such as common household items, yard and garden tools, sporting goods, and equestrian tack. Typical examples of items storable by hanging on the apparatus include brooms, mops, rakes, hoes, shovels, ski poles, back packs, lacrosse sticks, and the like. The apparatus may also be used to store items of clothing such as coats, ties, belts, bathroom towels and robes, and the like.

Notably, the apparatus of the invention is compact, and may be attached to a small supporting surface, such as, upon a narrow wall space confined between the corner of a room and a nearby door frame, or upon a post, or upon either side of a narrow door. Despite this compactness, the invention is versatile to permit a single apparatus to be used to store objects of different sizes. By merely adjusting the position of the apparatus with respect to the supporting surface, the user can adapt the apparatus to store items of disparate sizes. Furthermore, a single rack may be utilized to store simultaneously a plurality of items.

Referring generally to the drawings, wherein like reference numerals and symbols designate the same elements, there is seen in FIGS. 1–5 a preferred embodiment of the apparatus of the invention, and in FIGS. 6–12 an alternative embodiment. A single exemplar of the apparatus may be used to store items (not shown) of different sizes by merely modifying the position of the apparatus with respect to the supporting surface 28 upon which it is mounted. The apparatus includes a base 20 (FIGS. 1–5) or 20' (FIGS. 6–13) attachable to the supporting surface 28 in at least two different positions (for example, comparing FIG. 2 with FIG. 3, and FIG. 8 with FIG. 9, respectively). There are at least two pairs of peg apertures (designated by 40, 42 and 44, 46 in FIGS. 1–5, and by 40', 42' and 44' and 46' in FIGS. 8–13) in the base 20 or 20', with the distance between the apertures of one pair being greater than the distance between apertures of the other pair. Each of the apertures represents the opening on surface 22 of a respective one of at least four peg bores 30, 32, 34, 36 or 30', 32', 34', 36'.

As shall be more fully described herein, the particular base 20 or 20' used, and the orientation of the base upon the supporting surface 28 are selected in consideration of, among other factors, the amount of available space upon the supporting surface. One pair of apertures is selected whose separation distance more closely corresponds to a dimension of the object or objects to be stored. The base 20, or 20' is attached to the supporting surface 28 with the selected apertures defining a generally horizontal line. Pegs 60 and 62, or 60' and 62', are inserted into each of the selected pair of apertures, and held therein preferably by friction, or by glue, or other suitable means. The one or more objects to be stored is then hung on, over, and/or between the pegs 60, 62 or 60, 62'.

Figure 2:
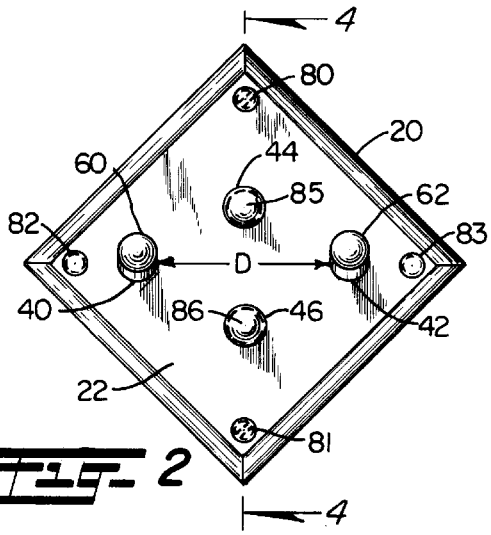
FIG. 2 is a front view of the preferred embodiment.
Figure 3:
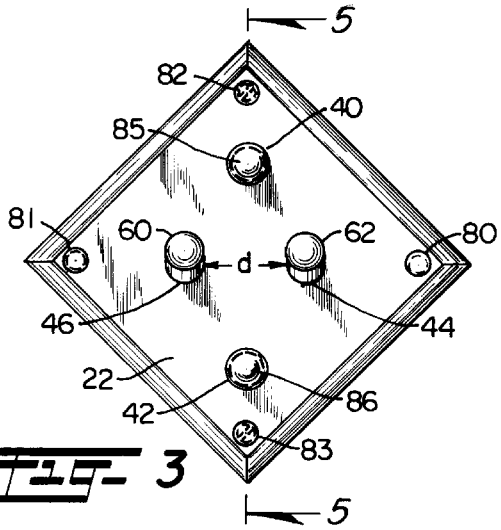
FIG. 3 is another front view of the preferred embodiment, showing the invention rotated approximately ninety degrees from the view in FIG. 2, also showing the pegs in another pair of peg bores.
Figure 4:
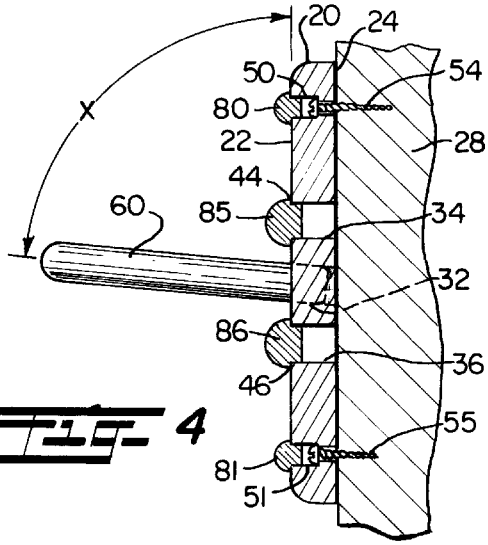
FIG. 4 is a side sectional view of the preferred embodiment, taken substantially along line 4—4 in FIG. 2 and attached to a supporting surface.
Figure 5:
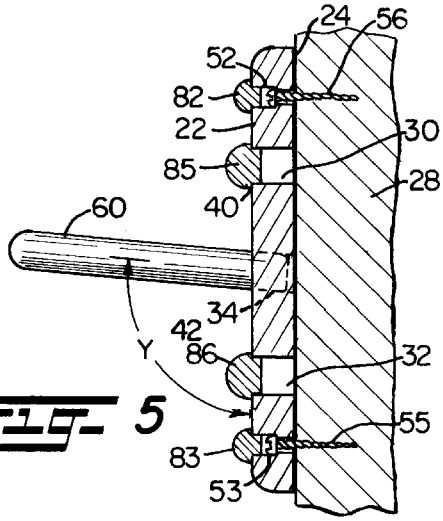
FIG. 5 is another side sectional view of the preferred embodiment, taken substantially along line 5—5 in FIG. 3 and attached to a supporting surface.

Particular reference is made to FIGS. 1–5. The base member 20 may be of nearly any practicable shape suggested by design, but preferably has a substantially flat front surface 22 and a substantially flat back surface 24. The base member 20 is attachable to the supporting surface 28 with the back surface 24 placed in parallel contact with the supporting surface 28. The base member 20 preferably is bilaterally symmetrical about two axes through a common center, there being shown by way of example a square base member 20 in FIGS. 1–3 and an elliptical base member 20' in FIGS. 6–9. The base member 20 is substantially solid and preferably is composed of wood. The thickness of the base member, that is the dimension separating the front surface 22 from the back surface 24, is comparatively modest relative to the other dimensions of the base member 20, but yet is adequate to define a plurality of peg bores 30, 32, 34, 36 therein, as shown in FIGS. 4 and 5.

FIGS. 1–5 illustrate that in one preferred embodiment, the base member 20 has at least four peg bores 30, 32, 34, 36 therein. The peg bores are provided in corresponding pairs, a first pair 30, 32 and a second pair 34, 36. As best shown by FIGS. 4 and 5, in this embodiment all the peg bores 30, 32, 34, 36 preferably completely penetrate the base member 20. Each pair of peg bores 30, 32 and 34, 36 define in the front surface 22 the corresponding pairs of apertures 40, 42 and 44, 46, respectively, where the peg bores 30, 32, 34, 36 open at the front surface 22. Each of the peg bores 30, 32, 34, 36 has a longitudinal axis, and preferably is axially symmetrical. The axes of associated pairs of peg bores 30 and 32 or 34 and 36 very preferably are parallel. In the preferred embodiment, the peg bores 30, 32, 34, 36, completely penetrate the base member 20. With peg bores completely piercing the base member 20 from front surface 22 to back surface 24, it is desirably possible to adjust the position of a peg 60 or 62 disposed in a particular peg bore by tapping on that peg from the direction of the back surface 24. Alternative embodiments may include peg bores which only partially penetrate the base member 20, so that an interior portion of the base member 20 separates each peg bore 30, 32, 34, 36 from the back surface 24.

Preferably, the peg bores 30, 32, 34, 36 are cylindrical to correspond to at least two cylindrical pegs 60, 62. Pegs 60, 62 are elongated dowels, preferably fashioned from solid wood, and are insertable axially into the peg bores 30, 32, 34, 36. In alternative embodiments, peg bores 30, 32, 34, 36 and pegs 60, 62 may have nearly any other cross-sectional shape suggested by design, provided that the cross-sectional shapes of pegs 60, 62 and respective peg bores 30, 32, 34, 36 substantially mutually correspond to allow a close-fitting, slidable, frictional insertion of the pegs 60, 62 into the peg bores 30, 32, 34, 36, for example as shown in FIG. 1.

Any mutually associated pair of pegs 60, 62 are substantially equal in length. As shown in FIGS. 1, 4, and 5, the pegs 60, 62 have sufficient length so that when they are in mated engagement with peg bores 30, 32, or 34, 36, each peg 60, 62 extends forwardly, that is, away from the front surface 22, out from the base member 20 to feature a free end projecting into space. In the preferred embodiment, both ends of each of the pegs 60, 62 are rounded to foster a smooth, nearly effortless insertion of either end of the pegs 60, 62 into the peg bores 30, 32, 34, 36.

Preferably, the pairs of peg bores 30, 32 and 34, 36 are disposed in the base member 20 so that the corresponding pairs of apertures 40, 42 and 44, 46, respectively, are arranged at substantially right angles to one another. FIGS. 2 and 3 illustrate that an imaginary line connecting the first pair of apertures 40 and 42 (specifically, connecting the centers of the apertures) is substantially perpendicular to an imaginary line connecting the second pair of apertures 44 and 46.

Particular reference is made to FIGS. 2 and 3. The first pair of apertures 40 and 42 are separated by a distance D. The second pair of apertures 44 and 46 are separated by a second distance d. The distance D is substantially greater than the distance d. The difference between the distances D and d is predetermined, and may vary between exemplars of the apparatus to provide a variety of storage capabilities among an assortment of racks.

Accordingly, the distance between inserted pegs 60, 62 depends upon whether the pegs 60, 62 are in the first pair of peg bores 30, 32, or the second pair of peg bores 34, 36. For example, as seen in FIGS. 1 and 2, the base member 20 may be attached to the supporting surface 28 in a position whereby the first pair of apertures 40 and 42, define a substantially horizontal line. When the pegs 60, 62 are inserted into the corresponding first pair of apertures 40, 42 as shown in FIG. 2, the pegs 60, 62 are separated by a distance approximately equalling D. In this configuration, the apparatus is positioned to store a larger item by hanging the item on, over, and/or between the spaced-apart pegs 60 and 62.

Notably, the same apparatus may be adapted for storing a smaller item thereon merely by rotating the base member 20 approximately ninety degrees to the position shown in FIG. 3 and attaching it to the supporting surface 28. In the position of FIG. 3, the second pair of apertures 44 and 46 define a substantially horizontal line. When the two pegs 60, 62 are inserted into the associated second pair of peg bores 34 and 36, the pegs 60, 62 are separated by a distance approximately equalling d. In this configuration, the apparatus is positioned to store a comparatively smaller item by hanging the item on and between the more closely spaced pegs 60 and 62. A person of ordinary skill in the art will readily appreciate that by providing a plurality of racks manifesting various permutations of different distances d and D between pairs of peg bores, a plurality of these inventive racks can satisfy a multitude of different storage demands.

When the pegs 60, 62 have been inserted into a selected pair of peg bores 30, 32 or 34, 36, the unused other pair of peg bores may be cosmetically covered by inserting dowel buttons 85, 86 therein as shown in FIGS. 1–5. Thus versatility is provided without seriously impacting the appearance of the apparatus.

In the illustrated embodiment, the base member 20 also has a plurality of countersunk mounting holes 50, 51, 52, 53 therethrough, through which connectors 54, 55, 56, 57 such as screws, brads, or the like may be passed to attach the base member to the supporting surface 28. Once the base member 20 is attached to the supporting surface 28, the mounting holes 50, 51, 52, 53 and the connectors 54, 55, 56, 57 may be aesthetically masked by inserting dowel buttons 80, 81, 82, 83 into the countersunk mounting holes as shown in FIGS. 1–5.

Continued reference is made to FIGS. 1–5. To improve the security with which stored items are hung upon the pegs 60, 62, each pair of peg bores 30, 32 and 34, 36, preferably penetrates the base member 20 at an angle such that when the inserted pegs 60 62 are inclined upwardly and forwardly from the base member 20. Thus, as seen in FIG. 4, the axes of the first pair of peg bores 30, 32 define an angle X with respect to the front surface 22. Similarly and as shown in FIG. 5, the axes of the second pair of peg bores 34, 36 define an angle Y with respect to the front surface 22. Whenever pegs 60 and 62 are inserted into either pair of peg bores 30, 32 or 34, 36, the pegs 60, 62 thereby define an acute angle with the base member 20, and extend upwardly from the supporting surface so that items disposed thereon will tend by gravity to remain in place.

Angle X may, but does not necessarily, substantially equal angle Y. It may be desirable to make angles X and Y unequal, which inequality may expand the versatility of the invention in some applications. However, the respective pairs of peg bores 30, 32 and 34, 36 are slanted into the base member 20 such that when a given pair (for example 40, 42) of either of the corresponding pairs of apertures are positioned substantially horizontally (for further example as depicted in FIG. 2), the angle defined between the axis of each of the corresponding peg bores (30, 32) and the front surface 22 is contained substantially within an imaginary vertical plane. By this configuration, the base member 20 is consistently attachable to the supporting surface 28 in a position where one of either pairs of apertures 40, 42 or 44, 46 defines an imaginary horizontal line, and where the axes of the corresponding pair of peg bores (30, 32 or 34, 36, respectively) are angled upwardly and outwardly from the supporting surface 28 as shown in FIGS. 4 and 5.

Consequently and notably, in the preferred embodiment and as best shown by combined reference to FIGS. 2–5, the axes of the first pair of peg bores 30, 32 are skewed with respect to the axes of the second pair of peg bores 34, 36. "Skewed" in this sense means neither parallel nor intersecting, regarding infinite lines. This skewed positional relationship of the respective pairs of peg bores 30, 32 and 34, 36, permits the base member 20 to be rotated upon the supporting surface 28, prior to being attached thereto, to properly position either pair of peg bores to receive the pegs 60, 62 in an upward angled disposition.

Figure 6:
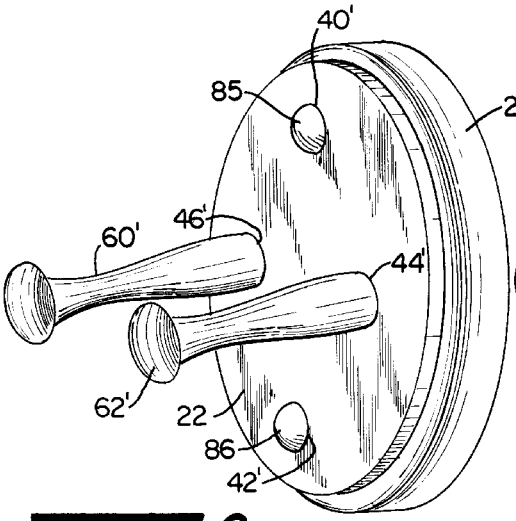
FIG. 6 is a perspective view of an alternative embodiment of the invention.
Figure 7:
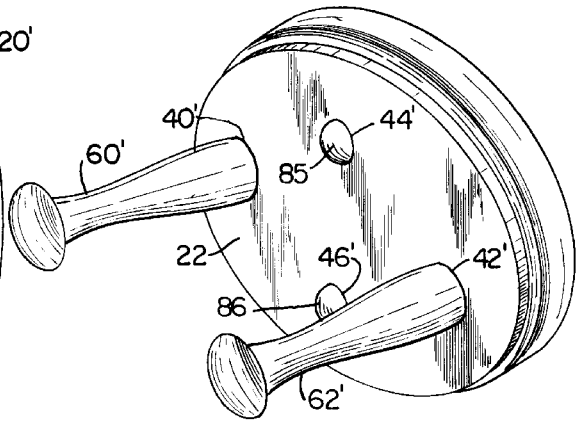
FIG. 7 is another perspective view of the alternative embodiment, showing the invention rotated approximately ninety degrees from the view in FIG. 6.
Figure 8:
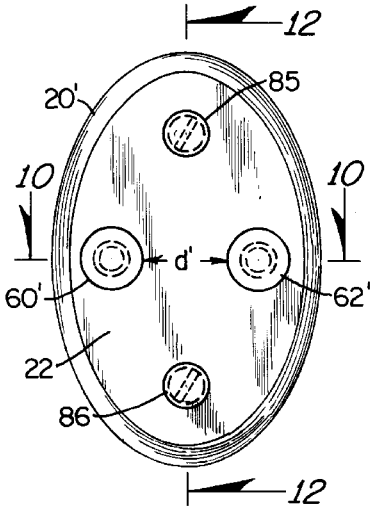
FIG. 8 is a front view of the alternative embodiment.
Figure 9:
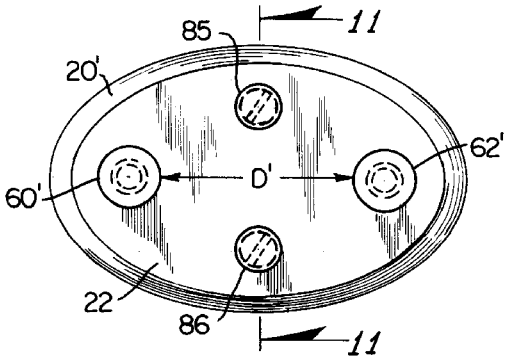
FIG. 9 is another front view of the alternative embodiment, showing the invention rotated about ninety degrees from the view in FIG. 8.

FIGS. 6–12 show an alternative embodiment of the invention. The alternative embodiment is substantially similar in most respects to the preferred embodiment, and like reference numerals and symbols designate elements of substantially similar form and function. In the alternative embodiment, the base member 20' may be oval or ellipsoid in outline. As with the preferred embodiment, the alternative embodiment may be attached to the supporting surface 28 in two functional positions, shown in FIGS. 6 and 7. In FIGS. 6 and 8, the base member 20' is positioned to place the second pair of peg apertures 44', 46' substantially horizontal to receive the pegs 60', 62' therein. The second pair of apertures 44', 46' are separated by a distance d' (not necessarily equal to d in the preferred embodiment). The first pair of apertures 40', 42', in this instance not used to frictionally receive pegs 60', and 62', are cosmetically covered using dowel buttons 85, 86 inserted therein. FIGS. 7 and 9, in contrast, show the base member 20' in a position rotated ninety degrees from the position of FIG. 6, so that the first pair of apertures 40', 42' are in a horizontal position separated by a distance D' and frictionally receive the pegs 60' 62' therein.

In this alternative embodiment, the peg bores 30', 32', 34', 36' penetrate straight into the base member 20', so that the axes of the respective peg bores define a substantially perpendicular angle with respect to the front surface 22. Accordingly, when the pegs 60', 62' are inserted into either of the pairs of peg bores 30', 32' or 34', 36', the pegs project substantially horizontally from the front surface 22' of the base 20' when the base is attached to a generally vertical supporting surface 28.

Figure 10:
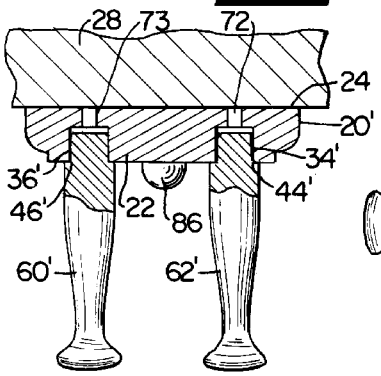
FIG. 10 is a top sectional view of the alternative embodiment mounted upon a supporting surface, taken substantially along line 10—10 in FIG. 8.
Figure 11:
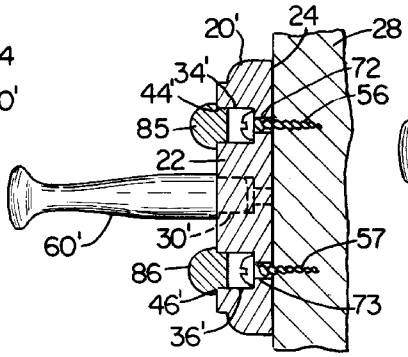
FIG. 11 is a side sectional view of the alternative embodiment mounted upon a supporting surface, taken substantially along line 11—11 in FIG. 9.
Figure 12:
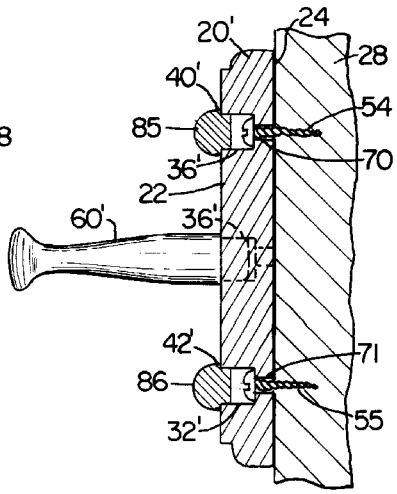
FIG. 12 is a side sectional view of the alternative embodiment mounted upon a supporting surface, taken substantially along line 12—12 in FIG. 8.

An aspect of the alternative embodiment is that the peg bores 30', 32', 34', 36' fill a role in the attachment of the base 20' to the supporting surface 28. We have determined that configuring the attachment means through the peg bores permits a more compact and aesthetic apparatus. As best seen in FIGS. 10–12, each of the peg bores 30', 32', 34', 36' only partially penetrates the base member 20'. A plurality of connector passages 70, 71, 72, 73 connect the peg bores 30', 32', 34', 36' with the back surface 24 of the base member 20'; each of the passages 70, 71, 72, 73 is substantially coaxial with its corresponding peg bore, and extends between the back surface 24 and the bottom of one of each of the peg bores 30', 32', 34', 36'. In this manner, connectors 54, 55, 56, 57, such as screws, or brads, or the like, are insertable through the passages 70, 71, 72, 73 and into the supporting surface 28 to attach the base 20' to the surface. Optionally, just two of the connectors are used only in the pair of passages 70, 71, or 72, 73 corresponding to the one pair of peg bores 30', 32', or 34', 36' which are not selected to receive pegs 60', 62'. Alternatively, connectors 54, 55, 56, 57 may be used in all the passages 70, 71, 72, 73. As seen in FIGS. 6–12, all the apertures 40', 42', 44', 46' may be cosmetically masked by the two pegs 60', 62' and two dowel buttons 85, 86, so that the front surface 22' is aesthetic.

Figure 13:
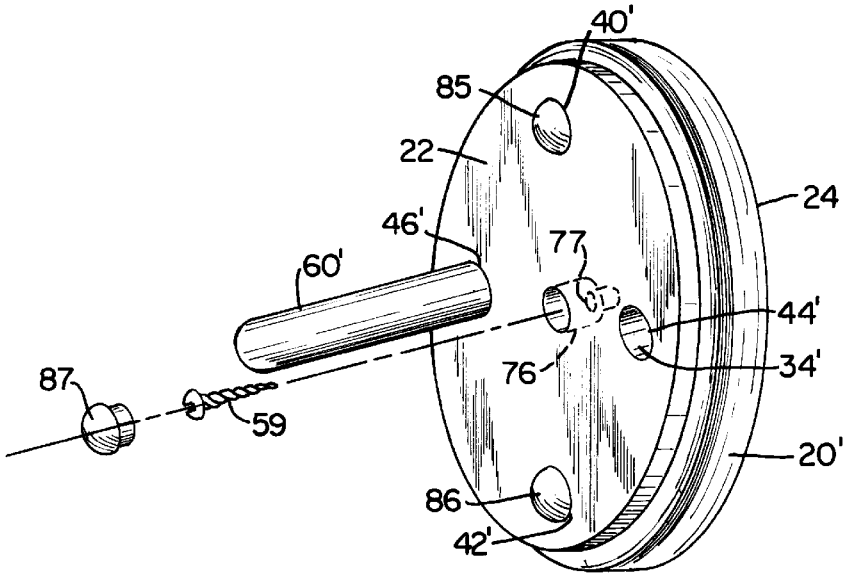
FIG. 13 is a perspective view of still another embodiment of the invention.

FIG. 13 illustrates that a base member of either embodiment, for example the base member 20' of the alternative embodiment, optionally may be provided perpendicularly and partially therethrough with a central bore 76 substantially similar to the peg bores 30', 32', 34', 36'. Coaxial with the main central bore 76 is a central connector passage 77, similar in configuration to the other connector passages 70, 71, 72, 73 previously described, which extends from the bottom of the central bore 76 to the back surface 24 of the base 20'. As illustrated by FIG. 13, a central connector 59, such as a screw, is disposable through the central connector passage 77 and into the supporting surface 28 to centrally fasten the base 20 to the supporting surface 28. Once the central connector 59 is screwed or hammered into holding contact with the bottom of the central bore 76, a central dowel button 87 may be inserted into the central bore 76 to cover the central bore 76 and connector 59.

This alternative embodiment provides a central connector 59 which may serve as an axis of rotation, whereby the rotational position of the base member 20' may be adjusted prior to final attachment to the supporting surface 28. Accordingly, the central connector 59 may first be disposed through the central connector passage 77 and partially inserted into the supporting surface 28. This allows the base member 20' to then be rotated slightly around the loosely inserted connector 59 to choose the precise position of the base member, and thereby select which pair of peg bores to use, prior to attaching the base member to the supporting surface with the other connectors 54, 55, 56, 57. The pegs 60', 62' can then be inserted into the selected pair of peg bores, for example bores 34' 36', for use.

In the event the user should later desire to rotate the base member 20' in order to make storage use of pegs 60' 62' in the other pair of peg bores 30' 32' to store a differently sized item, the fasteners 54, 55, 56, 57, may be "backed out" or otherwise removed from the supporting surface 28, and the central fastener 59 slightly loosened. The base member 20' is then free to be repositioned about the central fastener S to bring the other pair of peg bores 30', 32' into a useable substantially horizontal position prior to reinserting the connectors 54, 5S, 56, 57.

Figure 14:
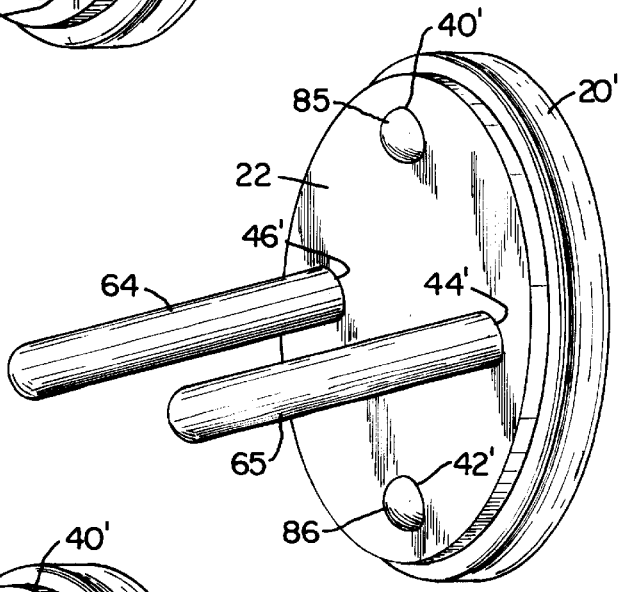
FIG. 14 is another perspective view of the embodiment shown in FIG. 13, showing pegs of a different length.
Figure 15:
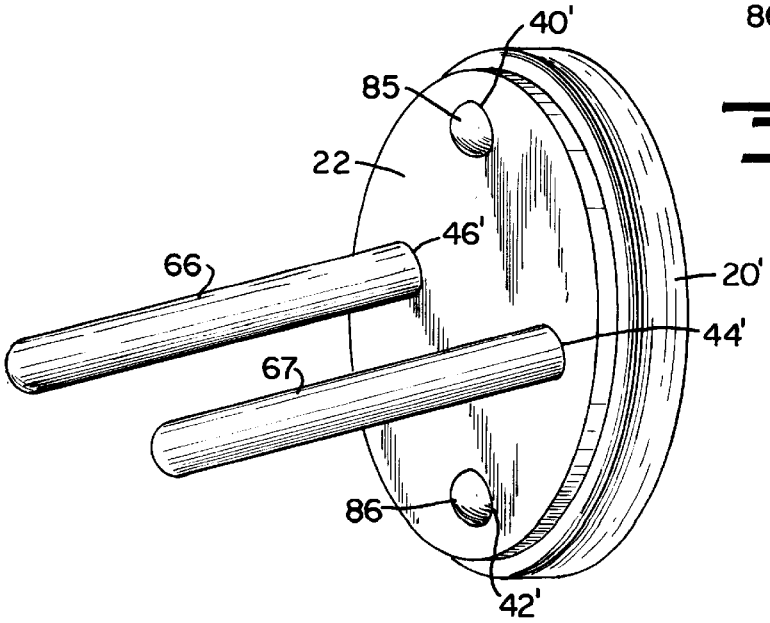
FIG. 15 is another perspective view of the embodiment shown in FIG. 13, showing pegs of yet another different length.

FIGS. 13–15 show that any embodiment of the apparatus of the invention may include additional pairs of elongate pegs 64, 65, and 66, 67. Each additional pair of pegs 64, 65 has a length different from the length of the main pegs 60', 62' (or 60, 62), and also different from the lengths of any other additional pair of pegs 66, 67. Because all pegs 60 or 60', 62 or 62', and 64, 65, 66, 67 preferably are removably insertable into the various peg bores 30, 30', 32, 32', 34, 34', 36, 36', the provision of a variety of peg lengths permits the user to mix and match peg lengths to customize the storage rack apparatus to his particular need. Notably, the use of longer pegs 66, 67 permits the storage of multiple items upon a single rack. For example, three brooms may be hung upon the pegs 66 67 in a single base 20'.

In one manner of practicing the invention, the user chooses a particular base member 20, preferably by comparing the distances d and D to a suitable dimension of the object desired to be stored. Ideally, one or the other of the distances d or D roughly corresponds to a portion of the object to be stored; if either distance, d or D, matches, the apparatus may be used to hang the object or objects in question. The distance d, for example, may correspond generally to the diameter of a hammer handle, and the user thus selects the apertures 44, 46 and associated peg bores 34, 36 to receive the pegs upon which the head of the hammer will rest. The base member 20 is then securely attached to the supporting surface 28, using at least two of the connectors, in a position where one or the other of the pair of apertures 44, 46 defines an imaginary horizontal line, and the axes of the corresponding pair of peg bores 34, 36 are inclined forwardly, up and out from the supporting surface 28. The user then chooses from any of the assorted pairs of pegs 60 and 62, or 64 and 65, or 66 and 67, to be inserted into the peg bores 34, 36. The head of the hammer is then rested upon the pegs, while the handle hangs therebetween. If desired, the pegs may be glued or otherwise permanently secured in the peg bores.

It is therefore to be understood that while preferred and alternative embodiments of the present invention are herein set forth and described, the above and other modifications and changes may be made without departing from the spirit and scope of the invention as defined by the appended claims and reasonable equivalents thereof.

We claim:

1. A storage rack apparatus comprising:

a base member attachable to an upright support surface, said base member having a front surface and a back surface;

a first pair of peg bores having passages penetrating said base member at spaced adjacent locations to one another, and being separated by a first distance;

a second pair of peg bores having passages penetrating said base member at spaced adjacent locations, and being separated by a second distance which differs from said first distance;

two elongate pegs, each of said page insertable into a respective bore of either one of said first and second pairs of peg bores;

means for interchangeably attaching said base member to said support surface where a selected one of said first and second pair of peg bores into which said pegs are inserted are in horizontally spaced relation to one another and the other of said first and second pairs of peg bores into which said pegs are not inserted are in vertically spaced relation to one another; and said attaching means comprising a fastener insertable through each bore of said other of said first and second pairs of peg bores, thereby attaching said base member to the supporting surface.

2. Apparatus according to claim 1, wherein each of said peg bores is disposed on an axis substantially perpendicular with respect to said front surface.

3. Apparatus according to claim 2, wherein said two pegs have substantially equal respective lengths, and further comprising at least one additional pair of elongate pegs interchangeably attached to said first and second pairs of bores, wherein the pegs of said additional pair of pegs have respective lengths different from the lengths of said two pegs.

4. Apparatus according to claim 3, wherein both ends of each of the pegs of at least one pair of said pairs of pegs are rounded.

5. A storage rack apparatus comprising:

a base member attachable to an upright support surface, said base member having a front surface, a back surface and being bilaterally symmetrical about a common center;

suspension means consisting only of first and second pairs of peg bores, said first pair of peg bores at least partially penetrating said base member at spaced locations substantially equidistant from said common center, and being separated by a first distance, said second pair of peg bores at least partially penetrating said base member at spaced locations substantially equidistant from said common center, and being separated by a second distance shorter than said first distance, wherein axes of said first pair of peg bores extend along a first oblique angle with respect to said front surface, and axes of said second pair of peg bores extend along a second oblique angle with respect to said front surface, and two elongated pegs, each of said pegs insertable into a bore of one of said first and second pair of said peg bores;

means for interchangeably attaching said base member to said support surface whereby respective bores of either one of said first and second pairs of peg bores into which said pegs are inserted are in horizontally spaced relation to one another and the other of said first and second peg bores are in vertically spaced relation to one another.

6. Apparatus according to claim 5, wherein axes of said first pair of peg bores define first inclined angles with respect to said front surface, and axes of said second pair of peg bores define second inclined angles with respect to said front surface.

7. Apparatus according to claim 6, wherein said axes of said first pair of peg bores are skewed with respect to said axes of said second pair of peg bores.

8. Apparatus according to claim 6, wherein said first angle is substantially unequal to said second angle.

9. Apparatus according to claim 7, wherein when said base member is attached to the supporting surface, a pair of apertures defined by one pair of said pairs of peg bores are aligned substantially vertically, the axes of the other pair of said pairs of peg bores are directed frontwardly and upwardly with respect to the supporting surface, and said two pegs are inserted in said other pair of peg bores.

10. Apparatus according to claim 9, wherein said two pegs have substantially equal respective lengths, and further comprising at least one additional pair of elongate pegs interchangeable with said two pegs, wherein the pegs of said additional pair of pegs have respective lengths different from the lengths of said two pegs.

11. Apparatus according to claim 10, wherein both ends of each of the pegs of at least one pair of said pairs of pegs are rounded.

12. The apparatus of claim 5, wherein said axes of said first pair of peg bores are skewed with respect to said axes of said second pair of peg bores.

13. The apparatus of claim 12, wherein said first angle is substantially unequal to said second angle.

14. The apparatus of claim 12, wherein said axes of said pair of peg bores in horizontally spaced relation are directed frontwardly and upwardly with respect to the supporting surface.

* * * * *